US006435270B2

(12) United States Patent
Freitag et al.

(10) Patent No.: US 6,435,270 B2
(45) Date of Patent: Aug. 20, 2002

(54) LAMINA STACK FOR A TWO-PASS EVAPORATOR

(75) Inventors: Oliver Freitag, Kirchheim; Alois Tischler, Aidenbach, both of (DE)

(73) Assignee: XCELLSIS GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 09/810,429

(22) Filed: Mar. 19, 2001

(30) Foreign Application Priority Data

Mar. 17, 2000 (DE) ..... 100 13 435

(51) Int. Cl.[7] ..... F28F 3/00

(52) U.S. Cl. ..... 165/166; 165/165; 159/26.1; 159/28.6

(58) Field of Search ..... 165/80.4, 185, 165/165, 170, 166, 146, DIG. 361, DIG. 364, DIG. 355, DIG. 356, DIG. 363; 159/13.3, 15, 18, 26.1, 27.3, 28.6, 28.3; 156/592; 29/890.039, 463

(56) References Cited

U.S. PATENT DOCUMENTS

| | | | | | |
|---|---|---|---|---|---|
| 1,826,344 | A | * | 10/1931 | Dalgliesh | 165/146 |
| 2,120,797 | A | * | 6/1938 | Cornell, Jr. | 165/170 |
| 2,587,116 | A | * | 2/1952 | Clay | 29/809.032 |
| 3,018,543 | A | * | 1/1962 | Beck | 165/146 |
| 3,106,014 | A | * | 10/1963 | Brick et al. | 165/170 |
| 3,916,644 | A | * | 11/1975 | Nasser | 165/166 |
| 4,111,659 | A | * | 9/1978 | Bowley | 165/170 |
| 4,678,027 | A | * | 7/1987 | Shirey et al. | 165/170 |
| 5,837,096 | A | * | 11/1998 | Fagerlind et al. | 159/13.3 |
| 6,050,330 | A | * | 4/2000 | Schmit et al. | 29/890.032 |

FOREIGN PATENT DOCUMENTS

| | | |
|---|---|---|
| DE | 44 26 692 C1 | 7/1994 |
| EP | 0022025 | 1/1981 |
| WO | 9966282 | 12/1999 |

OTHER PUBLICATIONS

Copy of Search Report.

* cited by examiner

*Primary Examiner*—Henry Bennett
*Assistant Examiner*—Terrell McKinnon
(74) *Attorney, Agent, or Firm*—Crowell & Moring LLP

(57) ABSTRACT

A lamina stack for a two-pass evaporator composed of laminae for converting two media mass streams from a liquid state into a gaseous state, comprises at least two laminae. Structures comprising recesses and raised regions on a first media lamina form a first media chamber perfused by one of the media mass streams. The structures on a second media lamina form a second media chamber perfused by the other one of the media mass streams. The at least two of the laminae can be supplied with thermal energy. Both media laminae have comparable structures, with at least a majority of the recesses in the one of the media laminae being disposed above or below the raised regions of the respective other media lamina.

11 Claims, 1 Drawing Sheet

LAMINA STACK FOR A TWO-PASS EVAPORATOR

BACKGROUND AND SUMMARY OF THE INVENTION

This application claims the priority of German patent application no. 100 13 435.1, filed Mar. 17, 2000, the disclosure of which is expressly incorporated by reference herein.

The invention relates to a lamina stack for a two-pass evaporator composed of laminae for converting two media mass streams from a liquid state into a gaseous state.

In principle, evaporators composed of laminae are known. One such evaporator is described for example in German patent document DE 44 26 692 C1. The two-stage (but not two-flow) evaporator unit described there serves to convert a liquid reactant mass stream, which can be adjusted as a function of a set, into a gaseous reactant mass stream. The liquid reactant mass stream evaporates at least partially in a first stage with the aid of a heat transfer medium and, if required, completely evaporates in a second stage and is then superheated. In so doing it is proposed that the evaporator unit be constructed by alternate stacking of laminae comprising heat transfer medium channels and of laminae comprising reaction channels, with at least a first and a second stage integrated in each lamina. The first stage is formed as a channel with a minimized cross-sectional area, which directly adjoins the inflow line, and is operated at high heat transfer values and. The overall cross section of the reaction channels in the second stage increases in the flow direction.

Also known in the general prior art are so-called two-pass evaporators. This means that the evaporator, which is heated by a heat-transfer medium or is subjected to direct heating, has two separate chambers for evaporating two separate reactant mass streams or media mass streams. In this case, each of the regions for the respective medium has at least one dedicated inlet region, but if the two media streams already mix in the outlet region of the evaporator and flow out through a common outlet region, one would nevertheless speak of two-flow evaporators.

If implemented in a plate or laminae design, these two-flow evaporators have a serious disadvantage owing to their construction. That is, the two media chambers of the two-pass evaporator are normally combined into one lamina stack, which is supplied with thermal energy by a heat-transfer medium, a catalytic combustion or the like. Recessed in the plates or laminae are passages, in which the media streams flow. Conventionally, large regions of the channel sections are arranged one above another, so that the supply of thermal energy through the lamina can take place virtually from one side only, as the already vaporous medium in the channels of the bottom lamina insulates the upper lamina at least partially with respect to the energy coming from below. Due to this fact, there is a major risk of formation of cold regions in which the medium, especially in situations where instead of closed ducts predominantly open structures are used on the laminae, forms regions in which the temperature is so low that the medium does not evaporate, or evaporates only to a limited extent. Thus it is possible for cold through-flow regions to be established, so that medium with a high fraction of liquid particles may exit from the evaporator.

It is therefore an object of the invention to provide a lamina stack for a two-pass evaporator composed of laminae which, using a simple and compact design, enables a distribution of the supplied thermal which is as even as possible.

Another object of the invention is to provide such an evaporator which has a small overall size, and is capable of uniform transfer of a high evaporator load.

These and other objects and advantages are achieved by the lamina stack according to the invention, which includes at least two laminae. Structures comprising recesses and raised regions on a first media lamina form a first media chamber perfused by one of the media mass streams. The structures on a second media lamina form a second media chamber perfused by the other one of the media mass streams. The at least two laminae can be supplied with thermal energy.

Recesses of one media lamina are disposed above or below raised regions of an adjacent media lamina. This structure ensures that over a major part of the lamina, the recesses will be surrounded by as many raised regions and areas of the laminae as possible. As these raised regions and areas of the lamina provide very good conduction of the thermal energy introduced into the lamina stack from outside, the recesses into which the media mass streams are flowing are supplied very efficiently and very uniformly with the thermal energy.

In a further, highly advantageous refinement of the invention, projection areas of the raised regions of the two media laminae overlap. A plan view of the laminae (a view perpendicular to the plane in which the laminae are situated) shows the projection areas of the raised regions of the respective lamina. It has now been found, surprisingly, by the inventors that the efficiency of the evaporation increases greatly if the raised regions of the two media laminae are offset relative to one another and if the projection areas of these raised regions at least touch, but ideally overlap in each case over a wider range.

The lamina stack for the two-pass evaporator according to the invention is particularly suitable if it relates to an evaporator heated by means of a gaseous heat transfer medium. The risk of overheating of these regions, which cannot be cooled by the media stream, is then smaller than with a comparable evaporator heated by means of a liquid heat transfer medium.

Other objects, advantages and novel features of the present invention will become apparent from the following detailed description of the invention when considered in conjunction with the accompanying drawings.

DETAILED DESCRIPTION OF THE DRAWINGS

Figure 1:
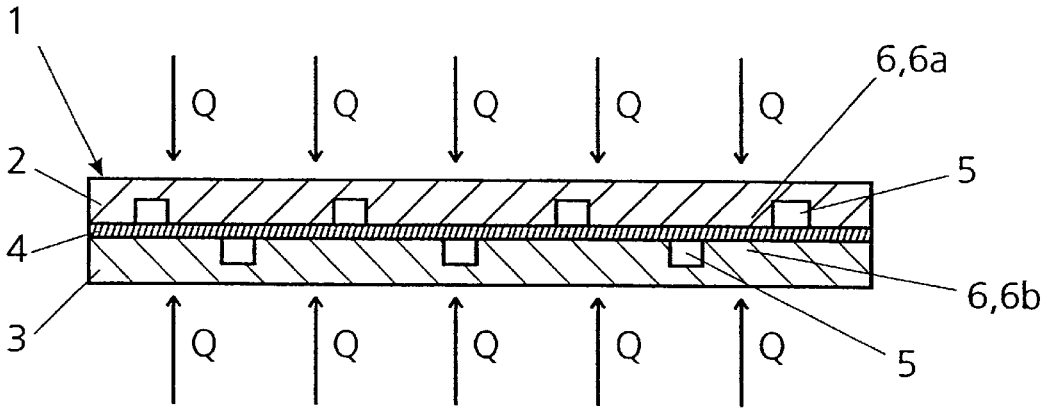
FIG. 1 shows a cross section through a lamina stack according to the invention.

FIG. 1 shows the design of a lamina stack 1 for an evaporator composed of laminae. (The evaporator itself is not shown in its entirety) . This lamina stack is supplied with thermal energy via a liquid or gaseous medium or via combustion (which can be catalytic, for example) . This supply of thermal energy is indicated by the arrows Q in FIG. 1. For this purpose it would be possible, for example, for the lamina stacks 1 to be stacked on top of one another alternating with corresponding chambers for the combustion or a heating medium. Since, however, the manner of supplying thermal energy is known and is not part of the invention, this aspect will not be discussed in any further detail.

The lamina stack 1 is composed of two media laminae 2, 3, which are separated from one another, in the illustrative embodiment shown here, by an intermediate lamina 4.

Recessed into each of the two media lamina 2, 3 are recesses or passages 5, which may, for example, be etched by means of an etching procedure from the lamina consisting e.g. of a high-alloy steel material. Flowing within these passages 5 recessed into the media laminae 2, 3 then is the respective medium.

In the two-pass evaporator shown here, the media chamber, formed by the passages 5, of the first media lamina 2 in this case is designated for one of the two media mass streams, while the media chamber in the second media lamina 3 is designated for the other one of the two media mass streams.

It can be seen in FIG. 1 that above the respective passages 5 metallic material of the two media laminae 2, 3 is disposed bilaterally, so that the supply of thermal energy Q into the passages 5 is not impaired by the respective passages 5 of the other of the two media lamina 3, 2.

In one possible design for the lamina stack, the media laminae 2, 3 are displaced relative to one another in at least one direction located in the plane of the media laminae 2, 3 by about half the distance between the centers of raised regions 6 intermediate the passages 5 of the respective media lamina in said direction. Depending on the design of the passages this results in an arrangement in which the projection area of the respective raised regions 6 of the two media laminae 2, 3 at least touch or partially overlap.

Figure 2:
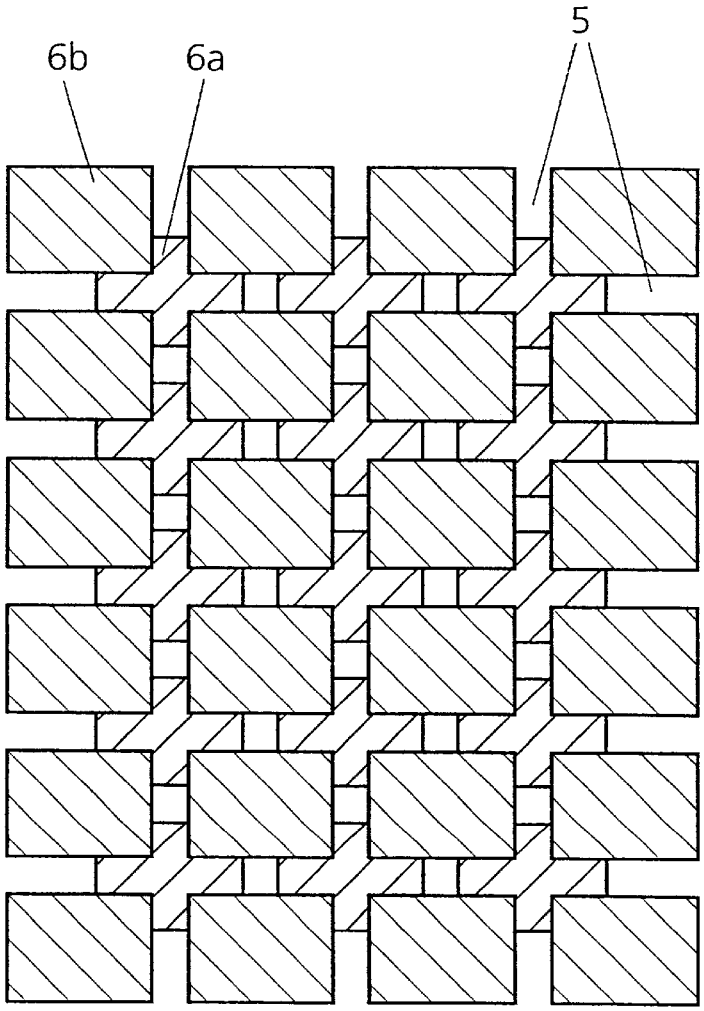
FIG. 2 shows a plan view of the projection areas of the raised regions of two media laminae.

FIG. 2 depicts these projection areas of the raised regions of the two media laminae. Here, the raised regions of the first media lamina 2 are identified by the reference symbol 6*a*, while the raised regions of the second media lamina 3 have the reference symbol 6*b*. This projection area of the respective raised regions, which is depicted perpendicularly to the plane of the laminae 2, 3, indicates that the raised regions 6 are arranged uniformly and alternately in such a way that at least a major share of the respective passages 5 is at least approximately uniformly distributed over the area of the two media laminae 2, 3, with these structures formed by the passages 5 and the raised regions 6 covering a major part of the area of the media laminae 2, 3. The raised regions 6 in such an arrangement should cover a very high proportion of the area of the respective media lamina, but at least one third of the area of the two media laminae which are provided with the structures.

In the illustrated embodiment shown in FIG. 2 this results in a pattern of passages or channels 5 criss-crossing with high uniformity, thus allowing for a highly uniform distribution of the media streams in these interconnected passages 5 in the respective lamina 2, 3, and allowing for highly uniform input of the thermal energy via the raised regions of, as the case may be, the respective media lamina 2, 3 and the intermediate lamina 4.

As an alternative to the illustrative embodiment depicted in FIG. 1, comprising the two media laminae 2, 3 and an intermediate lamina 4, other designs are of course also conceivable. For example, the first media lamina 2 together with the intermediate lamina 4 could be suitably rotated, thus resulting in a configuration comprising two media laminae 2, 3 and a covering lamina. In such an arrangement the covering lamina could have further structures on its side facing away from the media lamina 4, which structures are of potential use as guide elements for the heating medium.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A lamina stack for a two-pass evaporator composed of laminae for converting two media mass streams from a liquid state into a gaseous state via an input flow of thermal energy, said lamina stack comprising:

at least two media laminae disposed to receive energy from said flow of thermal energy;

structures comprising recesses and raised regions formed on a first of said media lamina, forming a first media chamber to be traversed by a flow of one of the media mass streams; and structures comprising recesses and raised regions formed on a second of said media lamina, forming a second media chamber to be traversed by a flow of the other one of the media mass streams, wherein:

both media laminae have comparable structures;

at least a majority of the recesses in the first media lamina is disposed adjacently above or below the raised regions of the respective other media lamina.

2. The lamina stack according to claim 1, wherein the media laminae are displaced relative to one another in at least one direction located in a plane of the media laminae, by approximately half the distance between respective centers of the raised regions in said direction.

3. The lamina stack according to claim 1, wherein projection areas of the raised regions of the two media laminae overlap in part.

4. The lamina stack according to claim 1, wherein an areal fraction of the raised regions of the two media laminae is at least one third of an area of the two media laminae comprising the structures.

5. The lamina stack according to claim 2, wherein the raised regions are distributed at least approximately uniformly over the two media laminae comprising the structures.

6. The lamina stack according to claim 1, wherein the structures are recessed by criss-crossing, mutually linked passages in the respective media laminae.

7. The lamina stack according to claim 1, further comprising an intermediate lamina sandwiched between the two media laminae, wherein the structures are formed in surfaces of the media laminae which face the intermediate lamina.

8. The lamina stack according to claim 1, consisting of two media lamina.

9. The lamina stack according to claim 1, consisting of two media lamina and an intermediate layer in between of the media lamina.

10. The lamina stack according to claim 1, comprising two media lamina and a covering layer in between of the two media lamina.

11. The lamina stack according to claim 10, wherein the covering layer comprises a side facing away from the media lamia, said side having structures as guide elements for heating medium.

* * * * *